US011578733B2

(12) United States Patent
Liu et al.

(10) Patent No.: US 11,578,733 B2
(45) Date of Patent: Feb. 14, 2023

(54) CENTRIFUGAL COMPRESSOR AND DIFFUSER

(71) Applicant: Gree Electric Appliances, Inc. of Zhuhai, Guangdong (CN)

(72) Inventors: Hua Liu, Guangdong (CN); Zhiping Zhang, Guangdong (CN); Jian Chen, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 0 days.

(21) Appl. No.: 17/287,885

(22) PCT Filed: Oct. 23, 2019

(86) PCT No.: PCT/CN2019/112761
§ 371 (c)(1),
(2) Date: Apr. 22, 2021

(87) PCT Pub. No.: WO2020/125193
PCT Pub. Date: Jun. 25, 2020

(65) Prior Publication Data

US 2021/0348622 A1 Nov. 11, 2021

(30) Foreign Application Priority Data

Dec. 17, 2018 (CN) ..... 201811542396.7

(51) Int. Cl.
*F04D 17/10* (2006.01)
*F04D 29/46* (2006.01)

(52) U.S. Cl.
CPC ..... *F04D 29/464* (2013.01); *F04D 17/10* (2013.01); *F05D 2250/90* (2013.01)

(58) Field of Classification Search
CPC ..... F04D 17/10; F04D 29/464; F05D 2250/90
See application file for complete search history.

(56) References Cited

U.S. PATENT DOCUMENTS 3,251,539 A * 5/1966 Wolfe ..... F04D 29/4213 415/207
3,365,120 A 1/1968 Jassniker
3,426,964 A 2/1969 Silvern
(Continued)

FOREIGN PATENT DOCUMENTS

CN 1745253 A 3/2006
CN 101195141 A 6/2008
(Continued)

*Primary Examiner* — Igor Kershteyn
*Assistant Examiner* — Theodore C Ribadeneyra
(74) *Attorney, Agent, or Firm* — The Webb Law Firm

(57) ABSTRACT

The disclosure relates to a centrifugal compressor and a diffuser; the diffuser includes a pressure drive mechanism, a first diffuser part, a second diffuser part and a movable diffuser part movable diffuser part being connected with the pressure drive mechanism and movably arranged on one of the first diffuser part and the second diffuser part; moreover, the movable diffuser part gets close to or leaves away from the other one of the first diffuser part and the second diffuser parts under the action of a pressure medium in the pressure drive mechanism so as to adjust a width of a pressure diffusion flow channel and prevent adverse phenomena such as gas flow stall and surging.

10 Claims, 4 Drawing Sheets

(56) References Cited

U.S. PATENT DOCUMENTS 3,478,955 A * 11/1969 Kunderman ..... F01D 17/143 415/158
4,219,305 A 8/1980 Mount et al.
4,257,733 A * 3/1981 Bandukwalla ..... F01D 17/143 415/13
4,378,194 A * 3/1983 Bandukwalla ..... F01D 17/143 415/49
4,416,583 A * 11/1983 Byrns ..... F04D 29/464 415/158
4,460,310 A * 7/1984 Plunkett ..... F04D 27/0246 415/48
4,579,509 A * 4/1986 Jacobi ..... F04D 29/441 415/199.1
4,611,969 A * 9/1986 Zinsmeyer ..... F04D 29/464 415/14
4,643,639 A * 2/1987 Caine ..... F04D 15/0038 277/412
4,844,690 A * 7/1989 DeLaurier ..... F01D 17/143 415/158
6,139,262 A * 10/2000 Ravidranath ..... F04D 29/464 415/126
6,872,050 B2 3/2005 Nenstiel
7,905,102 B2 * 3/2011 Bodell, II ..... F04D 27/0253 415/146
8,689,552 B2 * 4/2014 Iwata ..... F04D 29/462 415/48
9,874,226 B2 * 1/2018 Fukuyama ..... F04D 27/0253
2003/0010029 A1 1/2003 Lutz et al.
2009/0196741 A1 8/2009 Tsukamoto et al.

FOREIGN PATENT DOCUMENTS

CN 101526090 A 9/2009
CN 107642506 A 1/2018
CN 107654419 A 2/2018
CN 109356886 A 2/2019
CN 209294139 U 8/2019
DE 234751 C 5/1911
WO 2005054683 A1 6/2005

* cited by examiner

CENTRIFUGAL COMPRESSOR AND DIFFUSER

CROSS-REFERENCE TO RELATED APPLICATIONS

This application is the United States national phase of International Application No. PCT/CN2019/112761 filed Oct. 23, 2019, and claims priority to Chinese Patent Application No. 201811542396.7, filed on Dec. 17, 2018, the disclosures of which are hereby incorporated to the present application in their entirety.

BACKGROUND OF THE INVENTION

Technical Field

The disclosure relates to the technical field of compressors, in particular to a centrifugal compressor and a diffuser.

Description of Related Art

Air pressure in a centrifugal compressor is increased by rotation of an impeller and pressure diffusion of a diffuser. Specifically, in a centrifugal compressor, a high-speed rotating impeller applies a centrifugal force to air, and also realizes pressure diffusion of the air in a pressure diffusion channel, and thus air pressure is increased.

For a centrifugal compressor capable of working under dual conditions, a system requires a proper cooling capacity under both a refrigerating condition and a heating condition. Generally, there is little difference between the cooling capacities under the two working conditions, for example, the cooling capacity required under a heating condition is a little greater than that required under a refrigerating condition. Therefore, the two working conditions can share the same dynamic design. However, in some situations, there is a great difference between the cooling capacities required under the two working conditions. For example, the cooling capacity required under a heating condition is far lower than that required under a refrigerating condition, and accordingly the same aerodynamic design cannot simultaneously meet the requirements of the optimal cooling capacity range for the two working conditions. As a result, adverse phenomena such as gas flow stall and surging occur easily.

Generally, in order to widen an adjustable range of a centrifugal compressor to obtain a wider working condition range, an adjustable diffuser is arranged at an outlet of an impeller. The adjustable diffuser is driven to move to change the width of a diffuser flow channel. In this way, a minimum load for stable running of the compressor is lowered, the running range of the compressor is widened, and the flowing stability of a gas flow at the outlet of the impeller under a small-load working condition is improved. In addition, the adjustable diffuser is generally annular and is driven by a plurality of cam guide rod mechanisms. However, since a plurality of cam guide rod mechanisms have errors in machining, assembling and the like, they cannot move synchronously during driving. As a result, some guide rods may move, but some other guide rods are not starting to move, which may lead to inclination and chucking of the adjustable diffuser. Unreliable running of a movable diffuser part will cause ineffective adjustment, which will lead to a great risk of reduction of the running stability of a centrifugal compressor.

SUMMARY OF THE INVENTION

An embodiment of the present disclosure provides a centrifugal compressor and a diffuser, which can guarantee reliable running of a movable diffuser part.

One aspect of the embodiment of the present disclosure provides a diffuser including:

a pressure drive mechanism, a first diffuser part, a second diffuser part and a movable diffuser part, wherein the first diffuser part and the second diffuser part are oppositely spaced; a pressure diffusion flow channel communicating with an outlet of an impeller is formed between the first diffuser part and the second diffuser part; the pressure diffusion flow channel is used for pressure diffusion of a gas; and the movable diffuser part is connected with the pressure drive mechanism and is movably arranged on one of the first diffuser part and the second diffuser part, and is configured to get close to or leave away from the other one of the first diffuser part and the second diffuser part under the action of a pressure medium in the pressure drive mechanism so as to adjust an width of the pressure diffusion flow channel.

In the above-mentioned diffuser, the movable diffuser part is moved to adjust the width of the pressure diffusion flow channel. In this way, a proper cooling capacity is provided under both a refrigerating condition and a heating condition to prevent adverse phenomena such as gas flow stall and surging. In addition, the pressure drive mechanism applies a thrust to the movable diffuser part through a pressure medium. A positive pressure perpendicular to the surface of the movable diffuser part can be applied to the movable diffuser part by the pressure medium. Thus, the annular movable diffuser part can be accurately pushed to move in the axial direction of the pressure medium. In this way, the movable diffuser part is prevented from inclination and chucking caused by a thrust inclined relative to an axis, and the reliability and stability of movement of the movable diffuser part are improved. Simultaneously, when an annular movable diffuser part is driven by a plurality of pressure drive mechanisms spaced in a circumferential direction, the plurality of pressure drive mechanisms can be connected mutually, pressure mediums in the plurality of pressure drive mechanisms communicate with each other, and the flowing pressure mediums drive the plurality of pressure drive mechanisms to move synchronously. Thus, the movable diffuser part is synchronously driven at a plurality of points to move, only moves in the axial direction and remains the same position in other directions. The movable diffuser part can move smoothly to further guarantee the reliability of movement, and in this way the reliability of running of the centrifugal compressor is guaranteed.

In some embodiments, the diffuser further includes connecting pipes; the movable diffuser part is annular; and there are a plurality of pressure drive mechanisms. The plurality of pressure drive mechanisms are spaced in a circumferential direction of the movable diffuser part and are all connected with the movable diffuser part. All the pressure drive mechanisms are connected in series or in parallel through connecting pipes.

In some embodiments, the surface, facing toward the second diffuser part, of the first diffuser part is provided with a groove; the groove communicates with the pressure diffusion flow channel; and the movable diffuser part can be movably arranged in the groove.

In some embodiments, the movable diffuser part includes a first inclined surface facing toward the second diffuser part, and the first inclined surface is inclined to get close to the second diffuser part along the flowing direction of a gas flow in the pressure diffusion flow channel.

In some embodiments, the surface, facing toward the second diffuser part, of the first diffuser part includes a second inclined surface; and the second inclined surface is inclined to get close to the second diffuser part along the flowing direction of a gas flow in the pressure diffusion flow channel.

In some embodiments, the first inclined surface and the second inclined surface extend obliquely in the same direction, and the movable diffuser part is configured to make the first inclined surface be flush with the second inclined surface after moving to an extreme position close to the bottom surface of the groove.

In some embodiments, the pressure drive mechanism includes a cylinder and a piston, wherein the cylinder has an accommodating cavity; one end of the piston is slidably arranged in the accommodating cavity; the other end of the piston extends out of the cylinder and is connected with the movable diffuser part; and the piston is driven to slide by changing the volume of the pressure medium in the accommodating cavity.

In some embodiments, the pressure drive mechanism further includes an elastic member; the piston divides the accommodating cavity into a first cavity and a second cavity; the first cavity allows the pressure medium to flow in or out; the elastic member is accommodated in the second cavity; and the elastic member abuts between the piston and the inner wall of the second cavity along the moving direction of the piston.

In some embodiments, the piston includes a plug body and a rod body; the plug body is slidably arranged in the accommodating cavity along an axial direction; the rod body is connected to an axial side of the piston body, extends out of the cylinder via the second cavity and is connected with the movable diffuser part; the elastic member sleeves the outside of the rod body; and the two ends of the elastic member respectively abut against the plug body and the inner wall of the second cavity.

In some embodiments, the pressure drive mechanism further includes an inlet electromagnetic valve and an outlet electromagnetic valve; the first cavity is provided with a medium inlet and a medium outlet; the inlet electromagnetic valve is arranged at the medium inlet and configured to control the connection or disconnection of inflowing pressure medium; and the outlet electromagnetic valve is arranged at the medium outlet and configured to control the connection or disconnection of outflowing pressure medium.

In some embodiments, the surface, facing toward the second diffuser part, of the first diffuser part is provided with a groove, the groove communicates with the pressure diffusion flow channel, and the movable diffuser part is movably arranged in the groove; and the movable diffuser part is configured to form a preset gap with the bottom surface of the groove after moving to an extreme position close to the bottom surface of the groove.

In some embodiments, the pressure drive mechanism includes a cylinder, a piston and a cover, wherein the cylinder has an accommodating cavity; one end of the piston is slidably arranged in the accommodating cavity; the other end of the piston extends out of the cylinder and is connected with the movable diffuser part; and the cover seals the accommodating cavity;

an end face, toward the cover, of the piston is provided with a first lug boss; an end face, facing toward the piston, of the cover is provided with a second lug boss; the movable diffuser part is configured to form the preset gap between the movable diffuser part and the bottom surface of the groove when the first lug boss abuts against the second lug boss.

Another aspect of the embodiment of the present disclosure further provides a centrifugal compressor including an impeller and the above diffuser, wherein a pressure diffusion flow channel communicates with an outlet of the impeller.

DETAILED DESCRIPTION OF THE EMBODIMENTS

Figure 1:
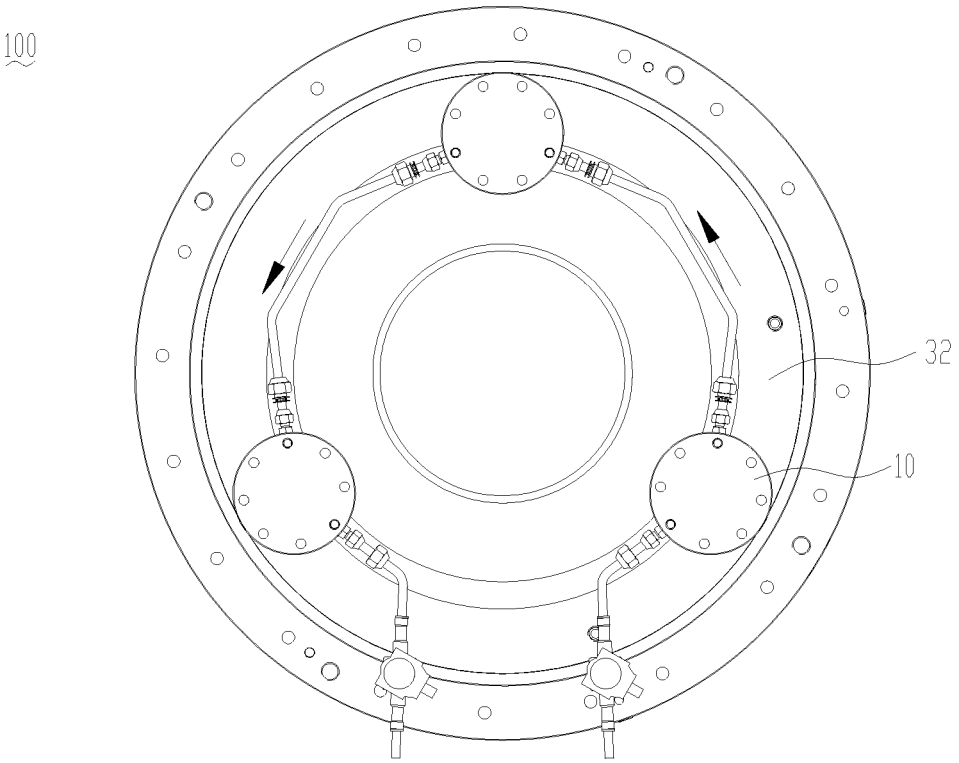
FIG. 1 shows a schematic diagram of the structure of a diffuser of some embodiments of the present disclosure from one perspective.

In order to facilitate the understanding of the present disclosure, the present disclosure will be described more comprehensively below with reference to relevant drawings. Preferred embodiments of the present disclosure are shown in the drawings. However, the present disclosure can be implemented in many different forms and is not limited to the embodiments described herein. On the contrary, these embodiments are provided to understand the content of the present disclosure more thoroughly and comprehensively.

It should be noted that when an element is referred to as being "fixed to" another element, it may be directly on the other element or there may be an intermediate element. When an element is considered to be "connected" with another element, it may be directly connected to the other element or there may be an intermediate element.

Unless otherwise defined, all technical and scientific terms used herein have the same meanings which are generally understood by those skilled in the technical field of the present disclosure. The terms used in the description of the present disclosure herein are merely intended to describe specific embodiments rather than to limit the present disclosure. The term "and/or" used herein includes any and all combinations of one or more related listed items.

Figure 2:
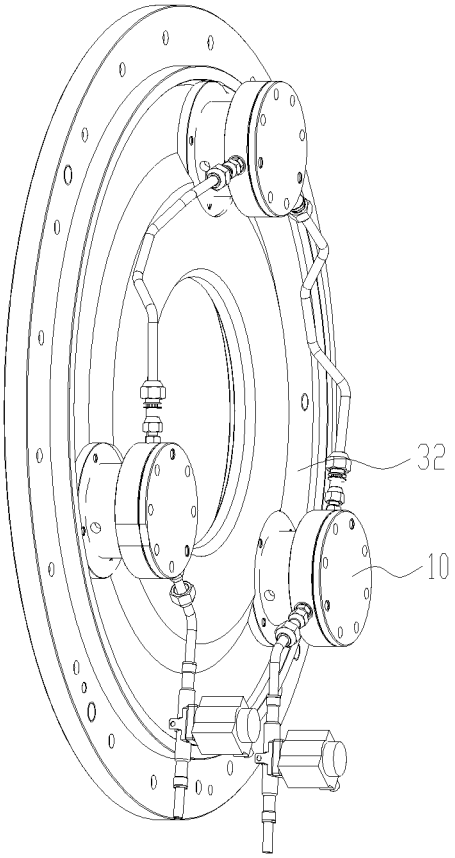
FIG. 2 shows a schematic diagram of the structure of the diffuser shown in FIG. 1 from another perspective.
Figure 3:
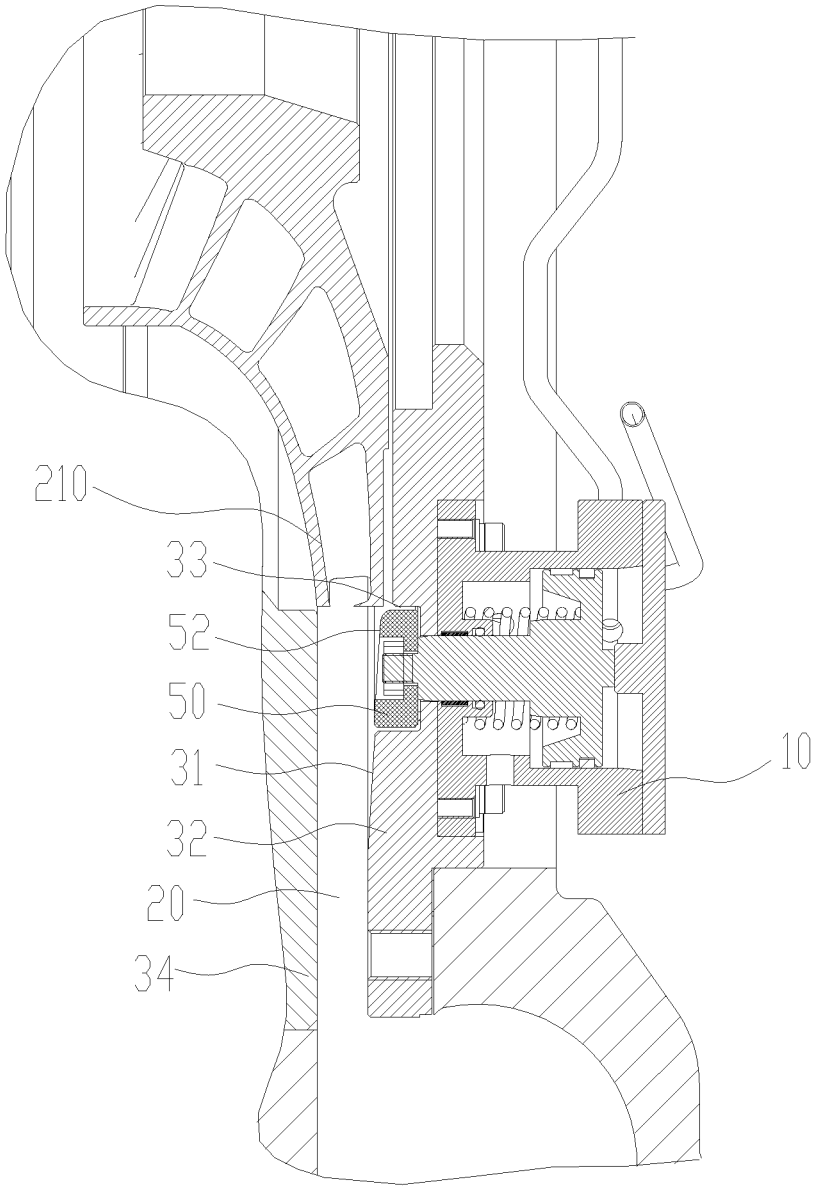
FIG. 3 shows a schematic cross-sectional view of the diffuser shown in FIG. 1.

As shown in FIGS. 1-3, in some embodiments of the present disclosure, a diffuser 100 is provided. The diffuser 100 is arranged at an outlet of an impeller 210 in a centrifugal compressor and is configured to increase the airflow pressure. In addition, a width of a pressure diffusion flow channel 20 in the diffuser 100 is adjustable, thus a cooling capacity of the centrifugal compressor during running is adjusted. In this way, so that the centrifugal compressor can provide a proper cooling capacity under both a refrigerating condition and a heating condition.

The diffuser 100 includes a pressure drive mechanism 10, a first diffuser part 32, a second diffuser part 34 and a movable diffuser part 50; the first diffuser part 32 and the second diffuser part 34 are oppositely spaced in an axial direction of the centrifugal compressor; a pressure diffusion flow channel 20 communicating with the outlet of the impeller 210 is formed between the first diffuser part 32 and the second diffuser part 34; and a gas flow flowing out of the impeller 210 is pressurized in the pressure diffusion flow channel 20. the movable diffuser part 50 is connected with the pressure drive mechanism 10 and is movably arranged on one of the first diffuser part 32 and the second diffuser part 34 and can get close to or leave away from the other one of the first diffuser part 32 and the second diffuser part 34 under the action of a pressure medium in the pressure drive mechanism 10 so as to adjust an width of the pressure diffusion flow channel 20. In this way, a proper cooling capacity can be provided under both a refrigerating condition and a heating condition to prevent adverse phenomena such as gas flow stall and surging.

In addition, the pressure drive mechanism 10 applies a thrust to the movable diffuser part 50 through a pressure medium. A pressure of a fluid is determined according to a cooling capacity of a compressor. The pressure medium can generate a positive pressure to the movable diffuser part 50, and the positive pressure is perpendicular to the surface of the movable diffuser part 50. The annular movable diffuser part 50 can be pushed to move in the axial direction. The movable diffuser part 50 can be prevented from being inclined and chucked due to a thrust inclined relative to an axis. The reliability and stability of movement of the movable diffuser part 50 are improved. Also, when an annular movable diffuser part 50 is driven by a plurality of pressure drive mechanisms 10 spaced in a circumferential direction, the plurality of pressure drive mechanisms 10 can be connected mutually, pressure mediums in the plurality of pressure drive mechanisms 10 communicate with each other, and the flowing pressure mediums drive the plurality of pressure drive mechanisms 10 to move synchronously. Thus, the movable diffuser part 50 is synchronously driven at a plurality of points to move in only the axial direction and remains the same position in other directions, so that the movable diffuser part 50 smoothly moves. Therefore, the reliability of movement of the movable diffuser part 50 is further guaranteed, and thus the reliability of running of the centrifugal compressor is guaranteed.

In addition, compared with a way of adopting a plurality of cam guide rod mechanisms, the way of adopting a pressure drive mechanism 10 to drive the movable diffuser part 50 can simplify a drive structure, the structure is compact, and space usage is reduced.

Specifically, the movable diffuser part 50 is arranged on the first diffuser part 32, and is movably arranged in a direction close to and away from the second diffuser part 34 under the driving of the pressure drive mechanism 10 so as to adjust a width of the pressure diffusion flow channel 20.

Figure 4:
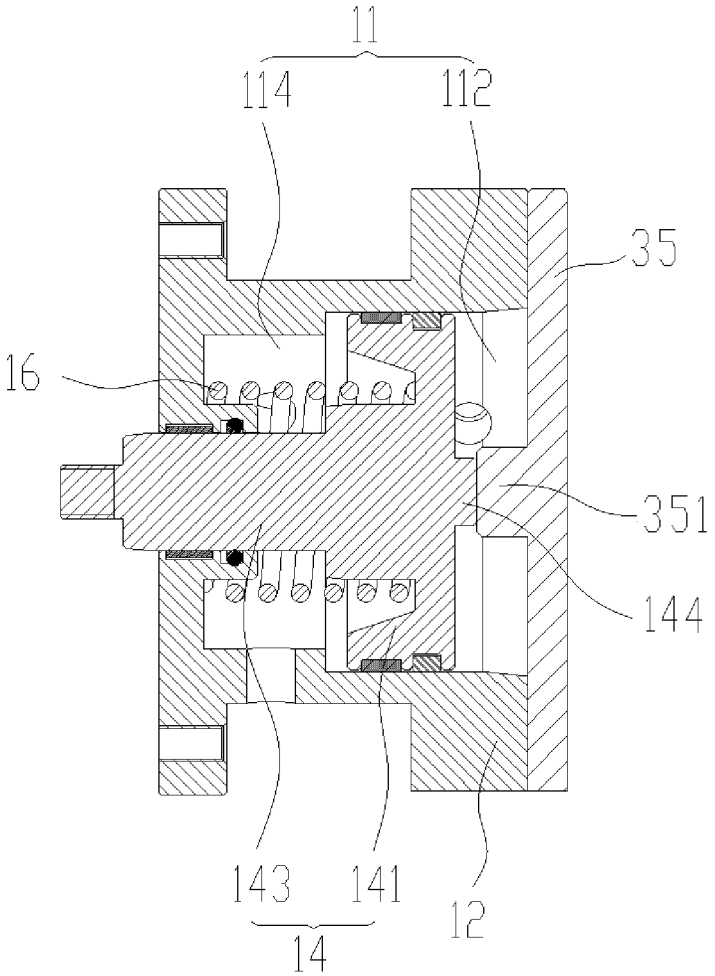
FIG. 4 shows a schematic cross-sectional view of a pressure drive mechanism in the diffuser shown in FIG. 1.

As shown in FIG. 4, the pressure drive mechanism 10 includes a cylinder 12 and a piston 14, wherein the cylinder 12 is provided with an accommodating cavity 11; one end of the piston 14 is slidably arranged in the accommodating cavity 11; the other end of the piston 14 extends out of the cylinder 12 and is connected with the movable diffuser part 50; and the piston 14 is driven to slide by changing the volume of a pressure medium in the accommodating cavity 11, and in this way the movable diffuser part 50 is driven to move. In other words, the piston 14 in the accommodating cavity 11 is driven to move by inflowing and outflowing of a pressure medium in the accommodating cavity 11. Thus, the piston 14 drives the movable diffuser part 50 to move and is applied with a pressure perpendicular to the surface of the piston 14, so that the piston 14 can slide smoothly, and the accuracy and reliability of running of the piston 14 and the movable diffuser part 50 are guaranteed.

The pressure drive mechanism 10 further includes an elastic member 16; the piston 14 divides the accommodating cavity 11 into a first cavity 112 and a second cavity 114; the first cavity 112 allows a pressure medium to flow in or out; the elastic member 16 is accommodated in the second cavity 114; and the elastic member 16 abuts between the piston 14 and the inner wall of the second cavity 114 along the moving direction of the piston 14. When a pressure medium flows into the first cavity 112, the volume of the first cavity 112 is increased under the action of the pressure medium; meanwhile, the piston 14 moves to one side of the second cavity 114; the volume of the second cavity 14 is compressed; and simultaneously, the elastic member 16, located in a moving route of the piston 14, in the second cavity 114 is compressed as well. When the pressure medium in the first cavity 112 flows out, an extrusion force applied to the compressed elastic member 16 is lowered, the elastic member 16 is restored, the piston 14 is driven to move to one side of the first cavity 112, and meanwhile the volume of the first cavity 112 is lowered. In this way, by filling the first cavity 112 with a pressure medium, the piston 14 can be controlled to move toward the second cavity 114 to drive the movable diffuser part 50 to move close to the second diffuser part 34; and by discharging the pressure medium from the cavity 112, the piston 14 can be controlled to move toward the first cavity 112 to drive the movable diffuser part 50 to move away from the second diffuser part 34, thereby changing the width of the pressure diffusion flow channel 20.

Specifically, the piston 14 includes a plug body 141 and a rod body 143; the plug body 141 can be slidably arranged in the accommodating cavity 11; the rod body 143 is connected to one side of the plug body 141, extends out of the cylinder 12 via the second cavity 14 and is connected with the movable diffuser part 50, so that the movable diffuser part 50 is driven to move by the rod body 143; in addition, the rod body 143 is externally sleeved with the elastic member 16; the two ends of the elastic member 16 respectively abut against the plug body 141 and the inner wall of the second cavity 114; and meanwhile the elastic member 16 is installed by virtue of the rod body 143. Specifically, the end face, facing toward the second cavity 114, of the plug body 141 is provided with an annular groove; the two ends of the elastic member 16 respectively abut against the bottom surface of the annular groove and the inner wall, away from the plug body 141, of the second cavity 114 in the axial direction.

Optionally, a sealing part may be arranged between the plug body 141 and the inner wall of the accommodating cavity 11; the sealing part is configured to seal the plug body 141 to prevent a pressure medium in the first cavity 112 and on one side of the plug body 141 from flowing into the second cavity 114 and being mixed with a refrigerant after entering the pressure diffusion flow channel 20, and thus influences on normal work of the refrigerant are avoided.

Figure 5:
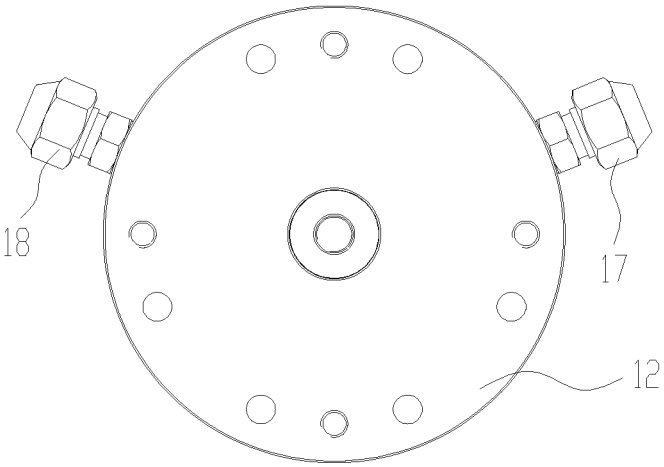
FIG. 5 shows a schematic diagram of the structure of a pressure drive mechanism in the diffuser shown in FIG. 1.

As shown in FIG. 5, the pressure drive mechanism 10 further includes an inlet electromagnetic valve 17 and an outlet electromagnetic valve 18; the first cavity 112 is provided with a medium inlet and a medium outlet; the inlet electromagnetic valve 17 is arranged at the medium inlet and configured to control the connection or disconnection of inflowing pressure medium; and the outlet electromagnetic valve 18 is arranged at the medium outlet and configured to control the connection or disconnection of outflowing pressure medium. In a process of adjusting the pressure medium, the pressure medium is flexibly controlled to flow in or flow out by powering on or powering off the inlet electromagnetic valve 17 and the outlet electromagnetic valve 18.

As shown in FIG. 1 and FIG. 2, further, the movable diffuser part 50 is annular; there are a plurality of pressure drive mechanisms 10; the plurality of pressure drive mechanisms 10 are spaced in a circumferential direction of the movable diffuser part 50 and are all connected with the movable diffuser part 50; moreover, the pressure drive mechanisms 10 are connected in series or in parallel through connecting pipes so as to synchronously drive the movable diffuser part 50 to move from a plurality of points; and thus a stable and reliable driving process is achieved.

As shown in FIG. 3, specifically, the surface, facing toward the second diffuser part 34, of the first diffuser part 32 is provided with a groove 33; the groove 33 communicates with the pressure diffusion flow channel 20; the movable diffuser part 50 is movably arranged in the groove 33 and is accommodated in the groove 33. Optionally, the groove 33 is configured in a ring shape and is matched with the movable diffuser part 50 in shape.

Further, the movable diffuser part 50 includes a first inclined surface 52 facing toward the second diffuser part 34, and the first inclined surface 52 is inclined to get close to the second diffuser part 34 along the flowing direction of a gas flow in the pressure diffusion flow channel 20, thereby forming a flow channel with a gradually-minimized section in the flowing direction of the gas flow, gathering a gas which is discharged from the impeller 210 and realizing pressure diffusion of the gas.

Furthermore, the surface, facing toward the second diffuser part 34, of the first diffuser part 32 includes a second inclined surface 31; and the second inclined surface 31 is inclined to get close to the second diffuser part 34 along the flowing direction of a gas flow in the pressure diffusion flow channel 20, thereby further forming a flow channel with a gradually-reduced section in the flowing direction of the gas flow and further increasing the pressure of the gas.

Optionally, after the movable diffuser part 50 is moved into the groove 33, for example, when the movable diffuser part 50 moves to an extreme position close to the bottom surface of the groove 33, the first inclined surface 52 is flush with the second inclined surface 31 based on a maximum cooling capacity of the compressor; and the first inclined surface 52 and the second inclined surface 31 obliquely extend in the same direction, so that the first inclined surface 52 and the second inclined surface 31 are smoothly butted in a transition manner to realize smooth pressure diffusion.

In order to prevent the movable diffuser part 50 from generating friction and collision with the second diffuser part 34 in an adjustment process, as shown in FIG. 3, a gap is formed between the movable diffuser part 50 and the bottom surface of the groove 33 when the movable diffuser part 50 moves to an extreme position close to the bottom surface of the groove 33. As shown in FIG. 4, in order to maintain the gap, the end face, away from the second diffuser part 34, of the cylinder 12 is provided with a cover 35; the cover 35 is configured to seal the first cavity 112; the end face, facing toward the cover 35, of the piston 14 is provided with a first lug boss 144; the end face, facing toward the piston 14, of the cover 35 is provided with a second lug boss 351; and the movable diffuser part 50 moves to an extreme position close to the bottom surface of the groove 33 when the piston 14 moves toward the cover 35 until the first lug boss 144 abuts against the second lug boss 351.

In some embodiments of the present disclosure, a centrifugal compressor is further provided and includes the diffuser 100 of the above embodiments. The movable diffuser part 50 is arranged at the outlet of the impeller 210 of the centrifugal compressor, and a width of the pressure diffusion flow channel 20 is adjusted according to working conditions. In this way, the centrifugal compressor runs reliably under different working conditions. Particularly, when the cooling capacities under different working conditions have a great difference, the centrifugal compressor can be adjusted to run close to an optimal design point under each working condition, thereby guaranteeing the running efficiency, widening the range of small-load running of the centrifugal compressor and reducing phenomena such as stall and surging.

Specifically, a plurality of pressure drive mechanisms 10 are spaced in a circumferential direction of the annular movable diffuser part 50; subsequently a pressure medium in each pressure drive mechanism 10 is controlled to flow in and flow out via the inlet electromagnetic valve 17 and the outlet electromagnetic valve 18; and thus the movable diffuser part 50 is controlled to move.

When the centrifugal compressor runs under a first load condition which is a heavy-load condition, the inlet electromagnetic valve 17 is closed, the outlet electromagnetic valve 18 is opened, a pressure in the first cavity 112 is decreased, and the piston 14 is kept at the rightmost end under the action of the elastic member 16. In this way, the movable diffuser part 50 connected with the piston 14 moves to the rightmost side of the groove 33. At the moment, the pressure diffusion flow channel 20 at the outlet of the impeller 210 is widest, and the impeller 210 can exert the highest power.

When the centrifugal compressor runs under a second load condition which is a small-load condition, a second load is smaller than a first load; if the pressure diffusion flow channel 20 is still widest, a refrigerant at the outlet of the impeller 210 may have phenomena such as stall and surging, and accordingly the centrifugal compressor stops running. Therefore, at the moment, the outlet electromagnetic valve 18 should be closed and the inlet electromagnetic valve 17 should be opened to allow a pressure medium to enter the first cavity 112. In this way, a pressure in the first cavity 112 is increased, thus the elastic member 16 is compressed to move the piston 14 leftwards to drive the movable diffuser part 50 to move leftwards; the pressure diffusion flow channel 20 at the outlet of the impeller 210 is narrowed, and the flowing speed of a refrigerant at the outlet of the impeller 210 is increased, thereby effectively preventing surging, greatly lowering a minimum load of the centrifugal compressor and widening the running range.

All technical features of the above-mentioned embodiments can be combined randomly; in order to make the description concise, not all possible combinations of the various technical features in the above-mentioned embodiments are described, however, as long as there is no contradiction between the combinations of these technical features, all should be considered as the scope of this specification.

The above embodiments merely show some implementations of the present disclosure, are described specifically in detail, but cannot be understood as a limitation to the scope of a patent for a disclosure. It should be noted that some transformations and improvements can be made by those of ordinary skill in the art without departing the concept of the present disclosure, and all these transformations and improvements are included in the protection scope of the present disclosure. Therefore, the protection scope of the patent of the present disclosure is subject to the described claims.

The invention claimed is:

1. A diffuser, comprising:

a pressure drive mechanism;

a first diffuser part and a second diffuser part spaced oppositely, wherein a pressure diffusion flow channel for pressure diffusion of a gas is formed between the first diffuser part and the second diffuser part, and a movable diffuser part, connected with the pressure drive mechanism and movably arranged on one of the first diffuser part and the second diffuser part; wherein the movable diffuser part is configured to get close to or leave away from the other one of the first diffuser part and the second diffuser part under the action of a pressure medium in the pressure drive mechanism, so as to adjust a width of the pressure diffusion flow channel;

a surface, facing toward the second diffuser part, of the first diffuser part is provided with a groove, wherein the groove communicates with the pressure diffusion flow channel, and the movable diffuser part is movably arranged in the groove;

the movable diffuser part comprises a first inclined surface facing toward the second diffuser part, and the first inclined surface is inclined to get close to the second diffuser part along the flowing direction of a gas flow in the pressure diffusion flow channel; and the surface, facing toward the second diffuser part, of the first diffuser part comprises a second inclined surface, and the second inclined surface is inclined to get close to the second diffuser part along the flowing direction of a gas flow in the pressure diffusion flow channel.

2. The diffuser according to claim 1, further comprising a plurality of connecting pipes, wherein the movable diffuser part is annular; a plurality of pressure drive mechanisms; the pressure drive mechanisms are spaced in a circumferential direction of the movable diffuser part and are connected with the movable diffuser part; and the pressure drive mechanisms are connected in series or in parallel through the connecting pipes.

3. The diffuser according to claim 1, wherein the first inclined surface and the second inclined surface extend obliquely in the same direction; and the movable diffuser part is configured to make the first inclined surface be flush with the second inclined surface after moving to an extreme position close to a bottom surface of the groove.

4. The diffuser according to claim 1, wherein the pressure drive mechanism comprises a cylinder and a piston, wherein the cylinder has an accommodating cavity; one end of the piston is slidably arranged in the accommodating cavity; another end of the piston extends out of the cylinder and is connected with the movable diffuser part; and the piston is configured to be driven to slide by changing the volume of a pressure medium in the accommodating cavity.

5. The diffuser according to claim 4, wherein the pressure drive mechanism comprises an elastic member; the piston divides the accommodating cavity into a first cavity and a second cavity; the first cavity is configured to allow the pressure medium to flow in or out; the elastic member is accommodated in the second cavity; and the elastic member abuts between the piston and an inner wall of the second cavity along the moving direction of the piston.

6. The diffuser according to claim 5, wherein the piston comprises a plug body and a rod body; the plug body is slidably arranged in the accommodating cavity along an axial direction; the rod body is connected to an axial side of the piston body and extends out of the cylinder via the second cavity and is connected with the movable diffuser part; the elastic member sleeves the outside of the rod body; and the elastic member has a first end and a second end, the first end abutting against the plug body and the second end abutting against the inner wall of the second cavity.

7. The diffuser according to claim 5, wherein the pressure drive mechanism comprises an inlet electromagnetic valve and an outlet electromagnetic valve; the first cavity is provided with a medium inlet and a medium outlet; the inlet electromagnetic valve is arranged at the medium inlet of the first cavity so as to control the connection or disconnection of inflowing pressure medium; and the outlet electromagnetic valve is arranged at the medium outlet of the first cavity and is configured to control the connection or disconnection of outflowing pressure medium.

8. The diffuser according to claim 1, wherein the movable diffuser part is configured to form a preset gap with a bottom surface of the groove after moving to an extreme position close to the bottom surface of the groove.

9. The diffuser according to claim 8, wherein the pressure drive mechanism comprises a cylinder, a piston and a cover, wherein the cylinder is provided with an accommodating cavity; the piston having a first end and a second end; the first end of the piston is slidably arranged in the accommodating cavity; the second end of the piston extends out of the cylinder and is connected with the movable diffuser part; the cover seals the accommodating cavity and has an end face facing toward the piston; and the second end of the piston facing toward the cover, is provided with a first lug boss; the end face of the cover is provided with a second lug boss; and the movable diffuser part is configured to form the preset gap between the movable diffuser part and a bottom surface of the groove after moving until the first lug boss abuts against the second lug boss.

10. A centrifugal compressor, comprising:

an impeller; and the diffuser according to claim 1;

wherein the pressure diffusion flow channel communicates with an outlet of the impeller.

* * * * *